US006761588B2

(12) United States Patent
Heebe et al.

(10) Patent No.: US 6,761,588 B2
(45) Date of Patent: Jul. 13, 2004

(54) COAXIAL CABLE QUICK CONNECT/ DISCONNECT CONNECTOR

(76) Inventors: Clark Heebe, 812 River Oaks Dr., Covington, LA (US) 70433; Warren G. Treme, 651 Richard St., Suite 2A, New Orleans, LA (US) 70130; Melvin L. Arroyo, 320 Madison, Gretna, LA (US) 70053

( * ) Notice: Subject to any disclaimer, the term of this patent is extended or adjusted under 35 U.S.C. 154(b) by 0 days.

(21) Appl. No.: 10/622,440

(22) Filed: Jul. 18, 2003

(65) Prior Publication Data

US 2004/0067675 A1 Apr. 8, 2004

Related U.S. Application Data

(63) Continuation of application No. 10/043,046, filed on Jan. 9, 2002, now Pat. No. 6,655,991.

(51) Int. Cl.[7] ..... H01R 17/18
(52) U.S. Cl. ..... 439/578; 439/348
(58) Field of Search ..... 439/578–585, 439/394, 944, 253, 348, 319, 333, 342, 345

(56) References Cited

U.S. PATENT DOCUMENTS 3,458,850 A 7/1969 Calisher
3,694,793 A 9/1972 Councelman
3,858,156 A 12/1974 Zarro
3,869,187 A 3/1975 Bingham
4,834,675 A 5/1989 Samchisen
4,941,846 A 7/1990 Guimond et al.
5,015,194 A 5/1991 Seas
5,217,393 A 6/1993 Del Negro et al.
5,439,386 A 8/1995 Ellis et al.
5,938,465 A 8/1999 Fox, Sr.
6,089,903 A 7/2000 Stafford Gray et al.
6,210,221 B1 4/2001 Maury
6,655,991 B2 * 12/2003 Heebe et al. ..... 439/578

* cited by examiner

*Primary Examiner*—Ross Gushi
(74) *Attorney, Agent, or Firm*—Keaty Professional Law Corporation

(57) ABSTRACT

A connector for quick connect/disconnect engagement between two or more segments of coaxial cable has a hollow housing for attaching to a first electrical conductor and a coupler for attaching to a second electrical conductor. The housing and the coupler move to a limited distance in a sliding relation to each other. A locking member is fitted between the housing and the coupler to lock position of the housing in relation to the coupler and disengage the housing from the coupler when needed. The locking member has a compression spring that normally urges the housing away from the coupler and locking balls fitted in cutouts made in the locking member. When the spring is compressed, the locking balls move from the cutouts into an annular groove formed in the inner wall of the housing, thus allowing a limited sliding movement of the housing.

11 Claims, 3 Drawing Sheets

COAXIAL CABLE QUICK CONNECT/ DISCONNECT CONNECTOR

This application is a continuation application of our application Ser. No. 10/043,046 filed on Jan. 09, 2002, now U.S. Pat. No. 6,655,991 entitled "Coaxial Cable Quick Connect/Disconnect Connector," the full disclosure of which is incorporated by reference herein.

BACKGROUND OF THE INVENTION

This invention relates to couplings, and more particularly to a connector that can be used for connecting segments of coaxial cables together, or for connecting coaxial cables to televisions, video players, DVD players, and other types of electronic equipment.

Many types of electronic equipment are connected with coaxial cables. The coaxial cables conventionally have an electrically conductive core. The core must be electrically connected with a receptacle mounted on the body of the television, VCR, and other similar equipment.

The core is encased in a non-conductive insulation. Before connecting the cable to a piece of an electronic equipment, the electrician has to crimp the end of the cable and attach a connector that has a threaded nut for engaging with the threaded receptacle on the electronic equipment to establish the electrical connection.

However, the electrician must have certain experience to perform the task of preparing a segment of cable for use. A lay person wishing to connect an outdoor antenna or cable to the indoor television usually does not possess these skills. Also, a lay person may not want to invest in expensive tools that allow cable crimping.

Even further, the connectors being usually on the back of a television set are not easily reachable. To unthread the connectors and remove the coaxial cable from the back of a television set may be awkward. This task may be particularly troublesome for people having limited movement in their hands. For this reason, various devices have been designed to make easier the connection between the coaxial cable and the television or VCR receptacle.

One such device is shown in U.S. Pat. No. 3,858,156 issued on Dec. 31, 1974 for "Universal Female Coaxial Connector". The '156 patent discloses a quick disconnect coupling that can be used for both push on and threaded connection. The device has a cylindrical outer conductor member with a flange and an insulating member inside. The outer conductor has two sections: the terminal threaded section, which extends one-third of the length of the connector member and a sleeve section with a resilient flap, which extends outwardly from the sleeve section. The free end of the sleeve has a diameter smaller than the adjacent threads, thereby utilizing the threads as a stop means when disengaging the connector.

U.S. Pat. No. 3,869,187 issued on Mar. 12, 1975 for "Quick Connect/Disconnect Coax Connector" discloses a connector perfectly suitable for radio frequency circuits. A single moveable working sleeve is used to work a standard jack into a circuit. The connector has a female portion with a hollow axial connecting terminal surrounded by an insulated sleeve. The insulator is held in place by an outer conductor cylinder and an inner working plug. The locking sleeve slightly moves on the outer conductor cylinder. The sleeve has locking fingers that engage in the slot of the outer cylinder. The male portion of the connector has an axial conductive extension for engaging the hollow connecting terminal of the female portion.

U.S. Pat. No. 4,941,846 issued on Jul. 17, 1990 for "Quick Connect/Disconnect Microwave Connector" discloses the use of a plurality of fingers surrounding the coaxial line segment. The fingers have inwardly facing ridges that match with the corresponding screw thread of the couplings. A sleeve is slidably mounted on the housing body and is provided with an internal cam surface. When the coaxial line segment of the connector is pushed into the couplings, the finger moves, causing the ridges to interlock with the screw thread. The coaxial line segment moves in relation to the housing body with the help of a compression screw.

U.S. Pat. No. 5,015,194 issued on May 14, 1991 for "Connector for Antennas and Coaxial Cable" discloses a clamp, which is combined with a polyamide sleeve to form a compression body. The connector has a lead with a pin, which connects to the transmission device. A support clamp allows connection to the transmission device. The sleeve engages the support clamp coupling to cause compression and non-yielding engagement between the support assembly contact shoulder and the connector end surface.

U.S. Pat. No. 5,938,465 issued on Aug. 17, 1999 for "Machined Dual Spring Ring Connector for Coaxial Cable" discloses the use of a split spring ring carried by a plug member set in a peripheral groove. When the two connectors are joined, the ring is compressed, compressing the peripheral ring into the circumferential notch formed in the split ring.

While these designs work satisfactorily in many environments, there is a need for an improved quick connect/disconnect coupling that can be used with for connecting unprepared segments of coaxial cable together, as well as to quickly connect/disconnect the coaxial cable and the electronic device.

SUMMARY OF THE INVENTION

It is therefore, an object of the present invention to provide a quick connect/disconnect coaxial cable connector.

It is another object of the present invention to provide a coupling that can be easily manipulated by people with restricted hand movement, while ensuring secure engagement of the coaxial cable with an electronic device.

It is a further object of the present invention to provide a coaxial cable connector that allows connecting segments of the cable without any specialized tools.

These and other objects of the present invention are achieved through a provision of a connector adapted to connect two electrical conductors, such as two or more segments of a coaxial cable. The connector comprises housing with a central opening, which receives an insulating insert therein. A plurality of gripping fingers is positioned in the insert for gripping a first electrical conductor. The gripping fingers also engage an elongated pin that extends from the insert outside of the housing.

The connector assembly also comprises a coupler for engaging with the second electrical conductor and a means for locking or disengaging the housing from the coupler to permit the quick connect/disconnect of the two electrical conductors. The locking means is fitted between the coupler and the housing. The locking means comprises a hollow cylindrical body with a plurality of cutouts. Each cutout receives a locking ball when the housing is locked in its position in relation to the coupler.

A compression spring urges the housing away from the coupler when the spring is released and the locking balls are engaged in the cutouts. When the spring is compressed, a shoulder on the inner wall of the housing forces the balls out from the cutouts and into the annular groove in the inner wall of the housing.

By pushing the housing towards and away from the coupler, the user can easily connect and disconnect the two coaxial cables.

BRIEF DESCRIPTION OF THE DRAWINGS

Reference will now be made to the drawings, wherein like parts are designated by like numerals, and wherein.

DETAILED DESCRIPTION OF THE PREFERRED EMBODIMENT

Figures 1, 2, 3:
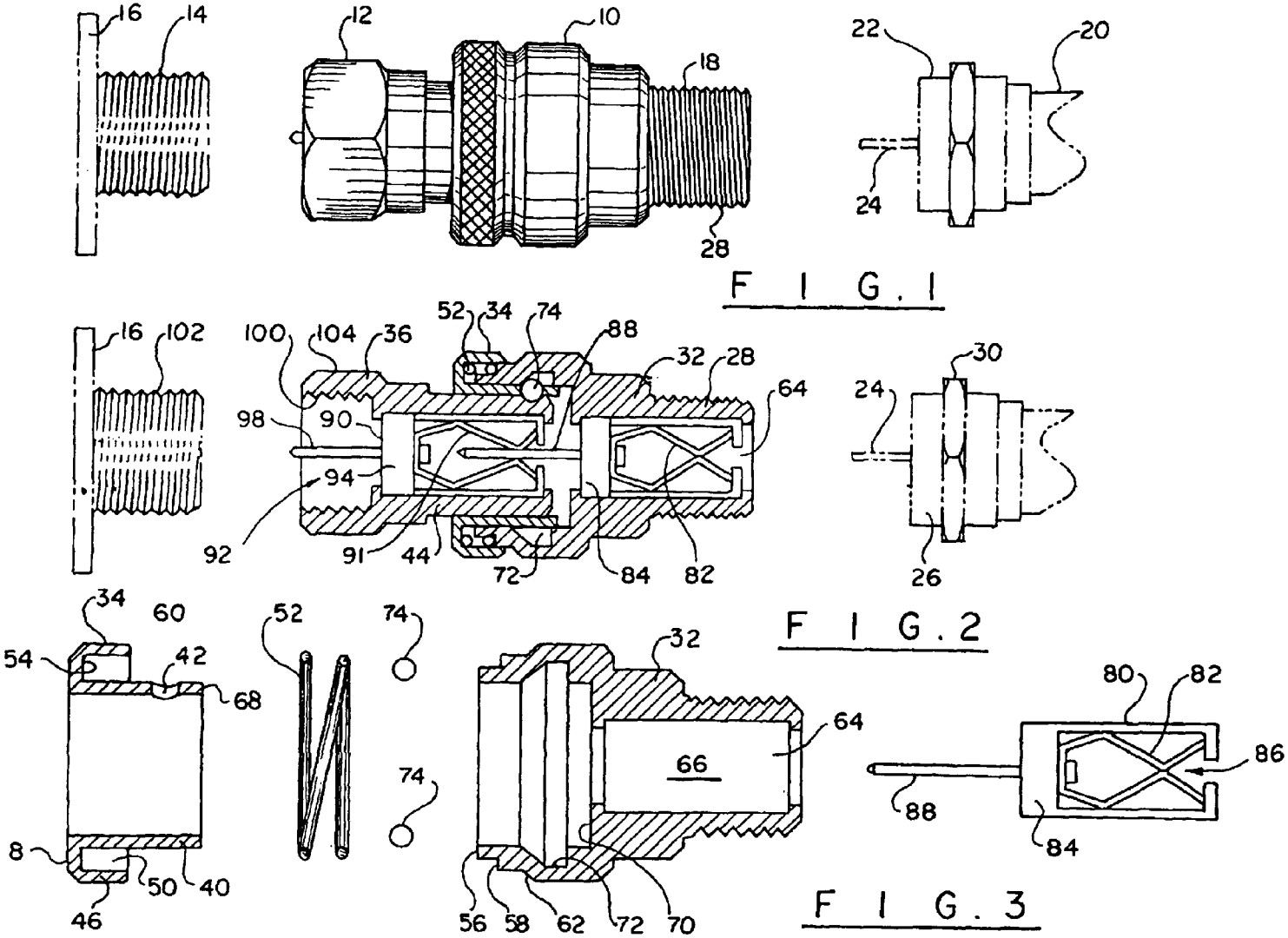
FIG. 1 is side view of the quick connect/disconnect coaxial connector in accordance with the present invention.
FIG. 2 is a cross-sectional view of the quick connect/disconnect coaxial cable connector of the present invention.
FIG. 3 is a detail exploded view showing the receiver housing and locking members used in the connector of the present invention.

Turning now to the drawings in more detail, the locking connector assembly of the present invention is designated by numeral 10. The assembly 10 comprises a first end 12 adapted for connecting to a receptacle 14 mounted on a television, VCR or other similar electronic equipment. The mounting wall of the electronic equipment is schematically illustrated at 16 in FIG. 1.

The assembly 10 comprises a second externally threaded end 18, which is adapted for connection to a coaxial cable 20. In the embodiment shown in FIGS. 1 and 2, the coaxial cable is provided with a conventional coupler component 22, which allows the electrical conductor core 24 to extend outwardly. The component 22 has inner threads (not shown) in the portion 26. The second end 18 of the assembly 10 is provided with threads 28 designed to match the threads of the conventional component 22 when a nut 30 is rotated, forcing the threads in the portion 26 to move over the threads 28.

The assembly 10 comprises a receiver housing 32, a ball retainer member 34, and a coupler 36. The ball retainer member 34 is provided with a first cylindrical portion 40 (FIG. 3) formed with ball receiving cutouts 42 therein. The first cylindrical portion 40 is sized and shaped to fit over at least a portion of a cylindrical portion 44 of the coupler 36.

The ball retainer member 34 has an outwardly extending flange 46 that is unitary connected to the cylindrical portion 40 through an end bridge 48. An annular space 50 is formed between the flange 46 and the exterior of the cylindrical portion 40. A tension spring 52 is fitted in the annular space 50, as shown in FIG. 2. The spring 52 urges against an end 56 of the receiver housing 32 and against an outwardly extending shoulder 58 of the receiver housing 32. The shoulder 58 is an annular shoulder formed by the body of the receiver housing 32, as can be better seen in FIG. 3.

Figure 4:
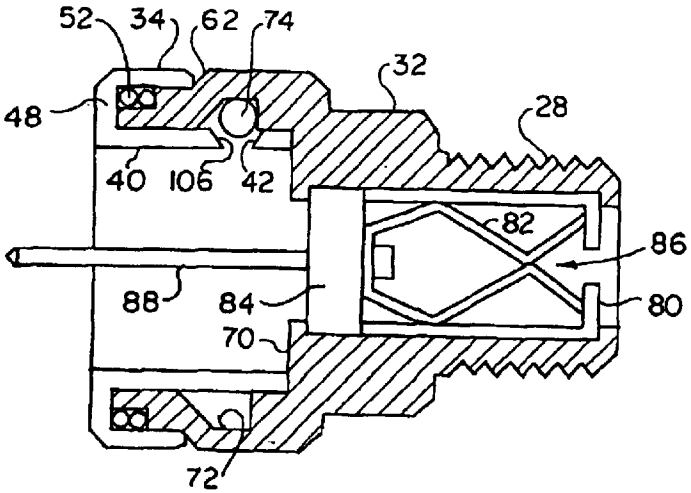
FIG. 4 is a detail view of the receiver housing showing the locking ball in a disengaged position and the ball retainer spring compressed.

The receiver housing 32 slides over the cylindrical wall 40 of the ball retainer member 34 such that an end 60 of the annular flange 46 abuts against an inclined shoulder 62 of the receiver housing 32 when the retainer spring 52 is compressed, as shown in more detail in FIG. 4.

The interior wall of the receiver housing 32 is provided with a central opening 64. The central opening 64 has a first elongated cylindrical cavity 66, connected with a plurality of different diameter cutouts formed in the interior of the housing 32.

An end 68 of the cylindrical portion 40 of the ball retainer member 34 contacts an inner shoulder 70 when the retainer spring 52 is compressed, as shown in FIG. 4. An enlarged diameter annular groove 72 is formed in the central opening 64. The annular groove 72 is adapted to receive a plurality of locking balls 74 mounted in the cutouts, or grooves 42 when the balls 74 are moved by the compression or release of the spring 52.

Figure 5:
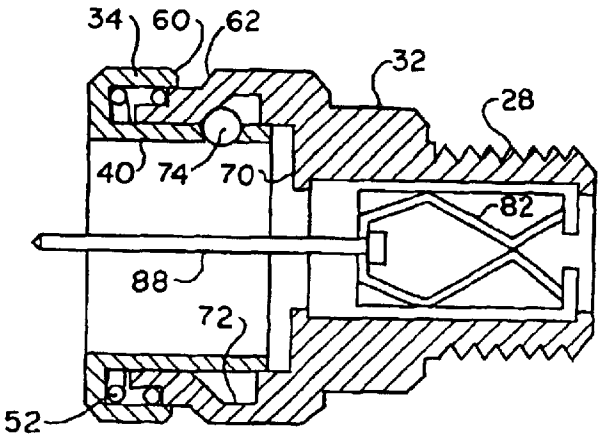
FIG. 5 is a detail view showing the receiver housing with the locking ball in a locked position and the retainer spring released.

In the preferred embodiment of this invention, three locking balls 74 are provided for fitting in the cutouts 42 and portions of the annular groove 72. When the receiver housing 32 moves in relation to the ball retainer member 34, the balls move between a disengaged position, as shown in FIG. 4 and a locked position, as shown in FIG. 5.

The assembly 10 further comprises a pair of coaxial cable inserts mounted in the central opening 64. A first insert, designated by numeral 80 in the drawings, is provided with a coaxial cable receiver 82 fitted into an insulated housing 84. The cable receiver 82 is formed from an electrical conductive material, such as copper. The cable receiver 82 is enclosed in an insulating enclosure 84 formed from a non-conductive material. The tension fingers of the cable receiver 82 form a narrow passage 86 for receipt of the cable core 24. When the conducting core, or wire 24 is inserted into the receiver 82, the fingers press against the core 24 and establish an electrical connection with a signal conductor pin 88, which extends from an interior of the insulating enclosure 84 to an exterior thereof.

The conductor pin 88 has a first end which engages the fingers of the cable receiver 82 inside the enclosure 84 and a second end, which extends a distance from the enclosure 84. The signal conductor pin 88, similarly to the coaxial cable receiver 82 is formed from an electrical conductive material. The insert 80 is fitted into the cavity 66 of the receiver housing 32, as shown in FIGS. 2, 4 and 5.

A second insert 90 is fitted in the central opening 92 of the coupler 36. The second insert 90 is similar, in all respects, to the insert 80. It is provided with compression fingers 91 for receiving the signal conductor pin 88 of the first insert 80. An insulating enclosure 94 houses the fingers, or the pin receiving members 91 and an inner portion of a conductor pin 98. The pin 98 transmits electrical signals from the core 24 of the coaxial cable 20 to the receptacle 14. The coupling member 36 is provided with inner threads 100 that are designed to mate with the threads 102 on the receptacle 14. An exterior surface 104 of the end 12 can be provided with machined surfaces to allow engagement of the end 12 by a wrench or similar tool to facilitate rotation of the assembly 10 when engaging with the receptacle 14.

FIGS. 2 and 5 show the locking ball in a locked position within the cutout 42 and the ball retainer spring 52 in a released position. When the user pushes the receiver housing 32 in the direction of the receptacle 14, the spring 52 becomes compressed, allowing the locking balls 74 to slide out from the opening 42 along the inclined surface 106 and move into the groove 72 of the receiver housing 32. At the same time, the end 68 of the cylindrical portion 40 comes into contact with an inner shoulder 70 of the receiver housing 32, as shown in FIG. 4. The locking balls are in a disengaged position.

By pushing again on the housing 32 and causing it to move axially in the direction of the receptacle 14, the user can again move the locking balls into a locked position, thereby affecting a quick connect/disconnect function of the assembly 10.

Figure 6:
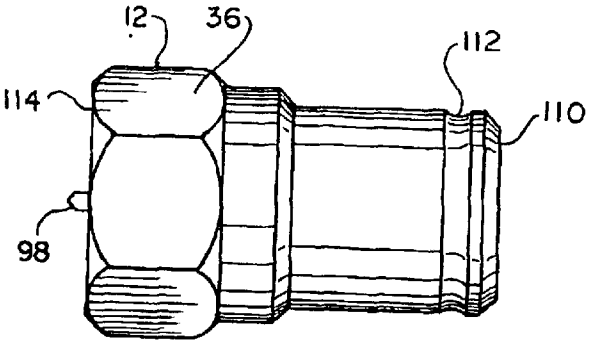
FIG. 6 is a detail view showing a side view of the coupler with a threaded female end.
Figure 7:
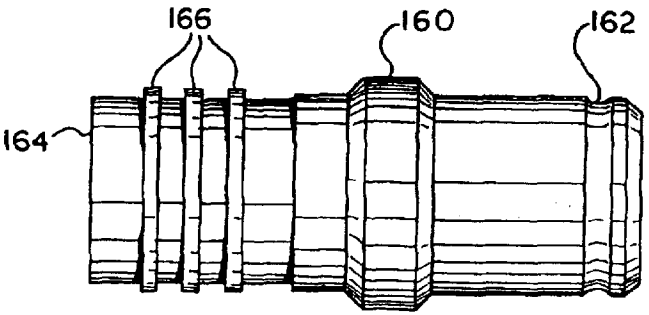
FIG. 7 is a detail side view showing a male end for connection to a coaxial cable.

FIG. 6 illustrates the threaded female end 12 and quick disconnect male end 110 of the assembly of the present invention. Also shown in FIG. 6, is an annular groove 112 for receiving a portion of the locking ball 74 (see, cross-sectional view of FIG. 2). As can be seen in FIGS. 2 and 6, the pin 98 of the insert 94 extends outside of the end 114 of the coupling member 36.

FIGS. 7–10 show a second embodiment of the insert of quick connect/disconnect assembly in accordance with the present invention. This embodiment is particularly convenient for situations where two segments of coaxial cable need to be connected. Such cases may arise when a cable connector is outside of the building or does not have a crimped end component 26.

As can be seen in the drawings, the quick connect/disconnect function of the assembly is performed by the mechanism, which is identical, in all respects, to the embodiment shown in FIGS. 1–6. The locking balls 124 rest in cutouts 126 of a ball retainer 128. A compression spring 130 is fitted between the ball retainer 128 and the receiver housing 132. An annular groove 134 formed in the receiver housing 132 receives the locking balls 124 when the spring 130 is compressed, allowing the receiver housing 132 to slide into engagement with the inner wall 136 of the ball retainer 128.

Figure 10:
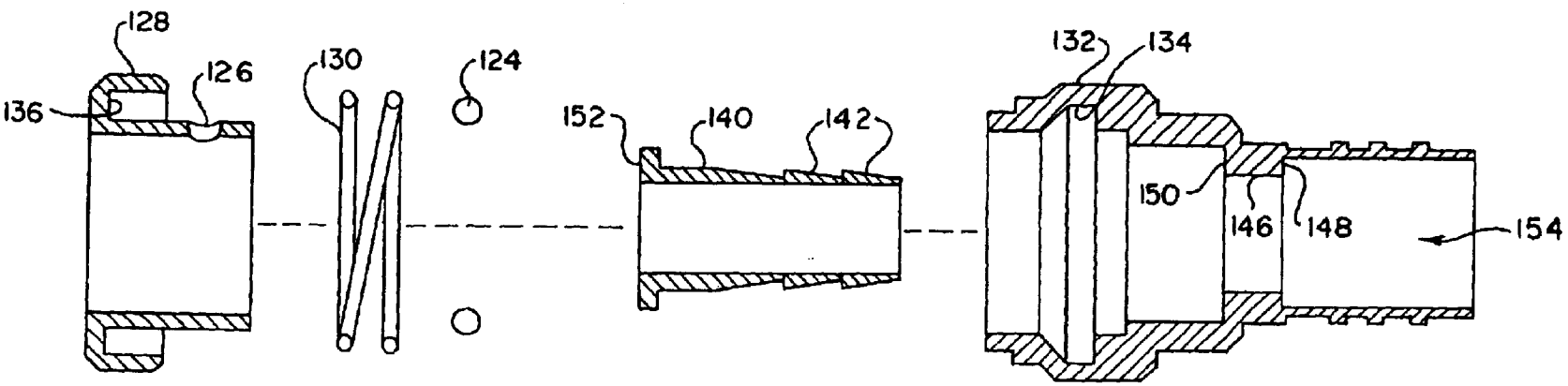
FIG. 10 is an exploded view of the receiver housing with the alternative coaxial cable insert.

Fitted in the receiver housing 132 is a coaxial cable insert 140. The insert 140 has one or more frustoconical projections 142 that fit between the central conductive core 24 of the coaxial cable 20 and an insulating covering. The insulation surrounding the core 24 becomes squeezed between the projections 142 and an interior wall 144 of the housing 132. The interior of the housing 132 is provided with a restricted diameter portion formed by portion 146 of the interior wall 144 (FIG. 10). The wall portion 146 is defined on its exterior end by an annular shoulder 148 and, on its inner end, by a shoulder 150.

Figure 9:
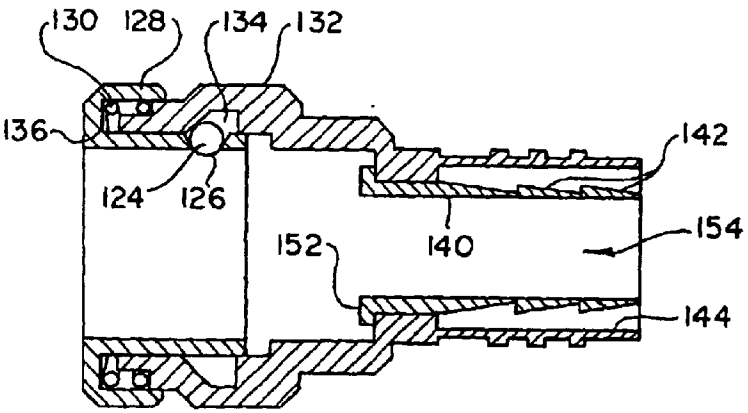
FIG. 9 is a detail cross-sectional view showing the receiver housing with an alternative insert member.
Figure 8:
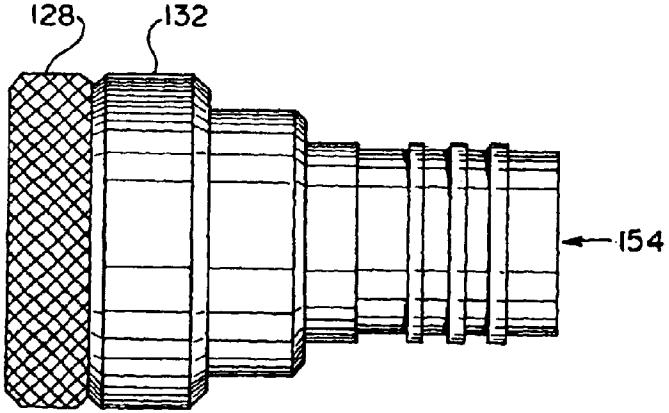
FIG. 8 is a detail side view showing a female end for attachment directly to a coaxial cable.

The shoulder 150 engages the underside of a peripheral flange 152 of the insert 140, as can be seen in FIG. 9. The insert 140 thereby becomes fitted against the wall 146, with a shoulder 150 preventing removal of the insert 140 through an end 154 of the central opening formed in the receiver housing 132.

When using the embodiment with the cable insert 140, there is no need to have a coupler 22 or crimp the edges of the cable 20. The user simply peels off the excess insulating material to expose the core wire 24 that will fit through the insert 140, extend through the receiver housing 132 and then through the ball retainer and a male end 160 (FIG. 7) of the assembly.

The coupler 160 is particularly suitable for connection to a coaxial cable that might extend on the outside of the building. The male end coupler 160 similarly to the coupler 36 is provided with an annular groove 162 for receiving at least a portion of the locking ball 124. An insert, similar to the insert 94, may be positioned, if desired, inside the coupler 160. The interior of the coupler 160 is provided with threads (not shown) adjacent to an end 164. The exterior is provided with projections 166 to facilitate engagement of the coupler with the cable receptacle.

The assembly of the present invention is particularly beneficial for occasions where the screw on, similar to the coupler 22, is not available. For instance, this occasional arises when the cable was purchased without the compression fitting that would normally come into contact with the outer shield of the cable. The compression fittings are difficult to install and need special equipment.

By avoiding the need for the compression fitting and by using the quick connect/disconnect assembly of the present invention, the user would not need to be trained as an electrical technician. The procedure would be simply to peel back the insulation exposing the center core wire and inserting it through the inserts fitted into the body of the receiver housing. The ridges 142 come into contact with the inside of the insulating sleeve enclosing the core 24. As a result, a positive connection is made between the outer insulating shield and the inner core member allowing to readily attach the two segments of the coaxial cable together. The need to purchase an expensive crimping tool can also be avoided, thereby providing substantial cost savings to a household owner.

The assembly of the present invention is made from conventional materials readily available on the market and can be inexpensively manufactured. The assembly is easily positioned over the connectable cable wires to provide a quick connect/disconnect function.

Many changes and modifications can be made in the design of the present invention without departing from the spirit thereof. I therefore pray that my rights to the present invention be limited only by the scope of the appended claims.

We claim:

1. A locking connector for electrically connecting segments of electrical conductors, comprising:

a housing for receiving a core of a first electrical conductor;

a coupler for connecting to a second electrical conductor mounted in a substantially coaxial engagement with the housing;

a means mounted in the housing and in the coupler for establishing an electrical connection between the first and the second electrical conductors, to which said housing and said coupler are connected; and a locking means mounted between the housing and the coupler for locking the housing to the coupler and disengaging the housing from a locked engagement with the coupler by axially moving the housing toward the coupler.

2. The device of claim 1, wherein said housing encloses at least one insulated insert adapted for engaging said core of the first electrical conductor.

3. The device of claim 1, wherein said means for establishing an electrical connection comprises a coaxial cable insert mounted in a central opening of each of said housing and said coupler.

4. The device of claim 1, wherein said housing comprises means for connecting the housing to the first electrical conductor.

5. The device of claim 4, wherein said means for connecting the housing to the first electrical conductor comprises threads formed on an exterior end portion of said housing.

6. The device of claim 4, wherein said means for connecting the housing to the first electrical conductor comprises circumferential projections formed on an exterior end portion of said housing.

7. A locking connector for electrically connecting segments of electrical conductors, comprising:

a housing for receiving a core of a first electrical conductor;

a coupler for connecting to a second electrical conductor mounted in a substantially coaxial engagement with the housing;

a means mounted in the housing and in the coupler for establishing an electrical connection between the first and the second electrical conductors, to which said housing and said coupler are connected; and a locking means mounted between the housing and the coupler for locking the housing to the coupler and disengaging the housing from a locked engagement with the coupler by axially moving the housing toward the coupler, said locking means comprising a retainer means for retaining locking members mounted between the housing and the coupler, a compression spring mounted between the retainer means and the housing, a plurality of locking members movable between a resting position in cutouts formed in the retainer means and an annular groove formed in the housing when the compression spring is compressed to thereby allow the housing to slide into engagement with an inner wall of the retainer means.

8. The device of claim 7, wherein said means for establishing an electrical connection comprises a coaxial cable insert mounted in a central opening of each of said housing and said coupler.

9. The device of claim 8, wherein each of said coaxial cable inserts is mounted in an independent insulating enclosure.

10. The device of claim 9, wherein the coaxial cable insert mounted in the housing comprises at least one gripping projection that is adapted to fit between the core of the first electrical conductor and the insulating enclosure to thereby force an insulating covering of the first electrical conductor between said at least one gripping projection and an interior wall of the housing.

11. The device of claim 10, wherein an inner wall of said housing is provided with an annular shoulder, and wherein said coaxial cable insert mounted in the housing is provided with a peripheral flange, said annular shoulder engaging said peripheral flange, thereby preventing removal of the coaxial cable insert from the housing.

* * * * *